US006427655B2

(12) United States Patent
Itoh et al.

(10) Patent No.: US 6,427,655 B2
(45) Date of Patent: Aug. 6, 2002

(54) INTAKE MANIFOLD OF OUTBOARD MOTOR

(75) Inventors: Jun Itoh; Ryuji Tanaka, both of Hamamatsu (JP)

(73) Assignee: Suzuki Kabushiki Kaisha, Hamamatsu (JP)

( * ) Notice: Subject to any disclaimer, the term of this patent is extended or adjusted under 35 U.S.C. 154(b) by 0 days.

(21) Appl. No.: 09/867,468

(22) Filed: May 31, 2001

(30) Foreign Application Priority Data

May 31, 2000 (JP) ..... 2000-162600
May 31, 2000 (JP) ..... 2000-162601

(51) Int. Cl.[7] ..... F02M 35/104
(52) U.S. Cl. ..... 123/184.42
(58) Field of Search ..... 123/184.42, 184.61, 123/184.21, 184.24, 184.23, 184.34, 184.47, 184.38, 195 P, 337, 195 R; 440/88

(56) References Cited

U.S. PATENT DOCUMENTS 5,341,773 A * 8/1994 Schulte et al. ..... 123/184.61
5,769,045 A * 6/1998 Edwards et al. ..... 123/184.61
6,109,231 A * 8/2000 Watanabe et al. ..... 123/184.42

FOREIGN PATENT DOCUMENTS

JP 09177624 A * 7/1997
JP 11-79085 3/1999

* cited by examiner

*Primary Examiner*—Gene Mancene
*Assistant Examiner*—Hyder Ali
(74) *Attorney, Agent, or Firm*—Oblon, Spivak, McClelland, Maier & Neustadt, P.C.

(57) ABSTRACT

An outboard motor is mounted with a multiple-cylinder engine and an intake air is distributed by an intake manifold to respective cylinders of the engine. The intake manifold is formed of synthetic resin and comprises a surge tank and a branch including a plurality of branch sections extending from the surge tank to the respective cylinders. The surge tank and the branch constitute an intake manifold body which is divided along a flow direction of the intake air flowing in the branch sections.

10 Claims, 11 Drawing Sheets

INTAKE MANIFOLD OF OUTBOARD MOTOR

BACKGROUND OF THE INVENTION

The present invention relates to an intake manifold of an outboard motor.

A multiple-cylinder engine mounted on an outboard motor or the like is provided with an intake manifold (or merely a manifold) for distributing intake air, the flow of which is regulated by a throttle body, to the respective cylinders of the engine. An intake manifold made of aluminum alloy has been normally employed, and an intake manifold made of synthetic resin has not been utilized till these days. However, it is initially adopted by the applicant of the subject application for forming a portion of the intake manifold downstream side of a throttle body of an intake device.

In many cases, the intake manifold is equipped with outfits such as filters, pumps, etc. A hose, a wire harness and the like provided among the outfit are fixed by clamps made of metal sheet or resin attached to the intake manifold by means of bolts.

However, the intake manifold made of aluminum alloy is heavy in weight and becomes larger in size as the displacement of the engine increases. Further, if the number of the cylinders of the engine increases, the number of branches thereof increases to thereby increase the weight of intake manifold.

On the other hand, if clamps are provided separately from the intake manifold, the number of parts and the number of assembling steps will be disadvantageously increased. In addition, in a case where it is necessary to provide screw holes in the intake manifold for attaching the clamps, the manufacturing cost of the intake manifold will be disadvantageously pushed up.

Further, in a certain arrangement, the intake manifold is also mounted with an engine hook for suspending an engine by a crane, for example. In another arrangement, the intake manifold is provided with a support boss for supporting an outboard motor at a time of being pushed over sideways.

On the other hand, as the intake manifold made of an aluminum has a high thermal conductivity, an insulator made of resin has been utilized for preventing heat from being transmitted at a time when a part such as delivery pipe is mounted.

However, an intake manifold made of resin has a rigidity lower than that of the aluminum intake manifold, and moreover, in a case where an outfit such as vapor separator having a relatively heavy weight is fixed to the resin intake manifold at two or three portions, it is difficult for the resin intake manifold to withstand against a vibration from the engine, thus being inconvenient.

Furthermore, in an arrangement in which the resin intake manifold is directly mounted to the engine hook, the resin intake manifold may not withstand against the weight of the engine and may be damaged when the engine is suspended.

Still furthermore, in an arrangement in which the support boss for supporting the outboard motor in a state of being pushed over sideways is provided for the resin intake manifold, it is difficult for the intake manifold to sufficiently support the outboard motor because of its heavy weight.

On the other hand, in a case where parts such as delivery pipe and the like are mounted to the intake manifold made of aluminum alloy, the use of resin insulator increases the number of parts or members, thus being inconvenient in economical point, assembling working and so on.

SUMMARY OF THE INVENTION

An object of the present invention is to substantially eliminate defects or drawbacks encountered in the prior art mentioned above and to provide an intake manifold for an outboard motor capable of reducing weight and cost and improving operational performance or operating property.

This and other objects can be achieved according to the present invention by providing an intake manifold of an outboard motor which is mounted with a multiple-cylinder engine and in which intake air is distributed by the intake manifold to respective cylinders of the engine, the intake manifold being formed of synthetic resin and comprising:

a surge tank; and a branch including a plurality of branch sections extending from the surge tank to the respective cylinders of the engine, the surge tank and the branch constituting an intake manifold body which is divided along a flow direction of the intake air flowing in the branch sections.

In a preferred embodiment, the intake manifold body is fixed to the engine directly at one portion and is fixed thereto, at another portion, through a throttle body to which a bracket is connected, and the intake manifold body has mating surfaces between the intake manifold body and the engine and between the intake manifold body and the throttle body, and sealing means are formed to the mating surfaces. Each of the sealing means is composed of a groove formed to the mating surface and an O-ring fitted to the groove. The bracket is formed with bolt holes in shape of slots.

The intake manifold body is provided with a plurality of reinforcement ribs extending in longitudinal direction thereof.

The divided intake manifold body is joined together by a vibration welding method.

The intake manifold body is provided with a hose clamp, the hose clamp is divided into halves, which are formed integrally with the divided portions of the intake manifold body, respectively, so that the divided halves take a form of a clamp when the divided portions of the intake manifold body are coupled together.

At least four attachment bosses for fixing an outfit of an outboard motor is provided on a surface of the intake manifold body on the side of the engine and the outfit is fixed to the attachment bosses. A mounting section of an engine hook for suspending the engine is arranged between an intake manifold fixing bosses provided at the engine and an interior of the intake manifold body so as to be fastened together by a bolt for fixing the intake manifold body.

A support boss used at a time of disposing an outboard motor to be sideways is disposed at substantially a central portion of the branch in a protruded manner. A delivery pipe constituting a fuel supply device is directly attached to the intake manifold body.

Further, it is to be noted that the term "intake manifold" used in the present specification generally means an intake manifold body including other portions, but may be, in some portions, used as an intake manifold unit, for example, including the intake manifold body.

As mentioned above according to the present invention, it is possible to reduce the weight of the intake manifold, to decrease intake air resistance, improve air filling efficiency and to reduce cost.

Further, in the preferred embodiments, it is possible to improve attachment rigidity to thereby improve the durability of the intake manifold. Moreover, it is possible to seal the surfaces of the intake manifold through which the intake manifold is coupled to the throttle body and the engine, respectively.

Moreover, since bolt holes of the brackets are formed to have long hole (slot) shapes, the deformation of the intake manifold can be absorbed by the bolt holes.

Furthermore, the location of a plurality of reinforcement ribs extending in longitudinal direction at the intake manifold makes it possible to improve the rigidity of the intake manifold and to prevent salt from adhering to the intake manifold even if seawater enters the outboard motor.

Further, since divided segments of the intake manifold are coupled to and integrated with each other by a vibration welding method, it is possible to obtain high coupling strength.

Additionally, the divided hose clamp halves are formed integrally with the divided segments of the intake manifold, respectively, so that the halves take a form of a clamp when the divided segments of the intake manifold are coupled together. It is, therefore, possible to reduce the number of parts and the number of assembly steps.

Furthermore, the location of the mounting bosses at, at least, four portions and the outfit such as vapor separator is secured, so that the oscillation (resonation) of the outfit due to the engine vibration can be suppressed effectively, thus improving the durability of the intake manifold.

Since the mounting portion of the engine hook is disposed and clamped between the intake manifold fastening boss and the inside portion of the intake manifold, any load is not applied to the intake manifold at a time when the engine of the outboard motor is suspended.

The location of the support bosses makes it possible to sufficiently support the outboard motor at a time when it is mounted in a horizontally falling state.

Furthermore, the direct mounting of the delivery pipe to the intake manifold can reduce the parts or members to be assembled and the assembling workability can be hence improved.

The nature and further characteristic features of the present invention will be made more clear from the following descriptions made with reference to the accompanying drawings.

DESCRIPTION OF THE PREFERRED EMBODIMENT

The embodiment of the present invention will be described hereunder with reference to the accompanying drawings.

Figure 1:
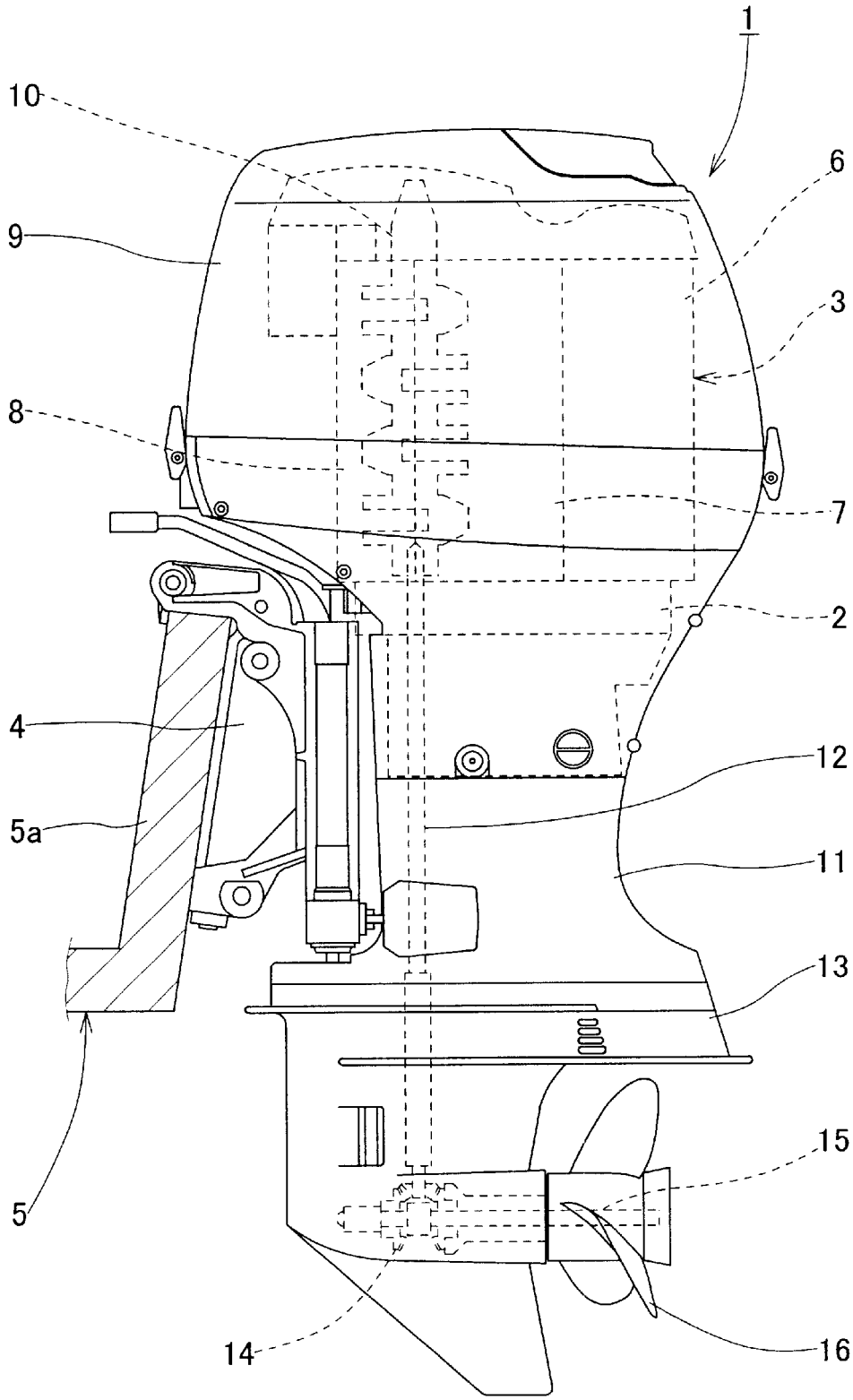
FIG. 1 is a left side view of an outboard motor showing one embodiment of an intake manifold of an outboard motor according to the present invention.

FIG. 1 is a left side view of an outboard motor 1 to which the present invention is applied. As shown in FIG. 1, the outboard motor 1 is provided with an engine holder 2 and an engine 3 is disposed above the engine holder 2 in an illustrated state. Further, a clamp bracket 4 is attached to the engine holder 2 and the outboard motor 1 is installed to the transom 5*a* of a hull 5.

Figure 2:
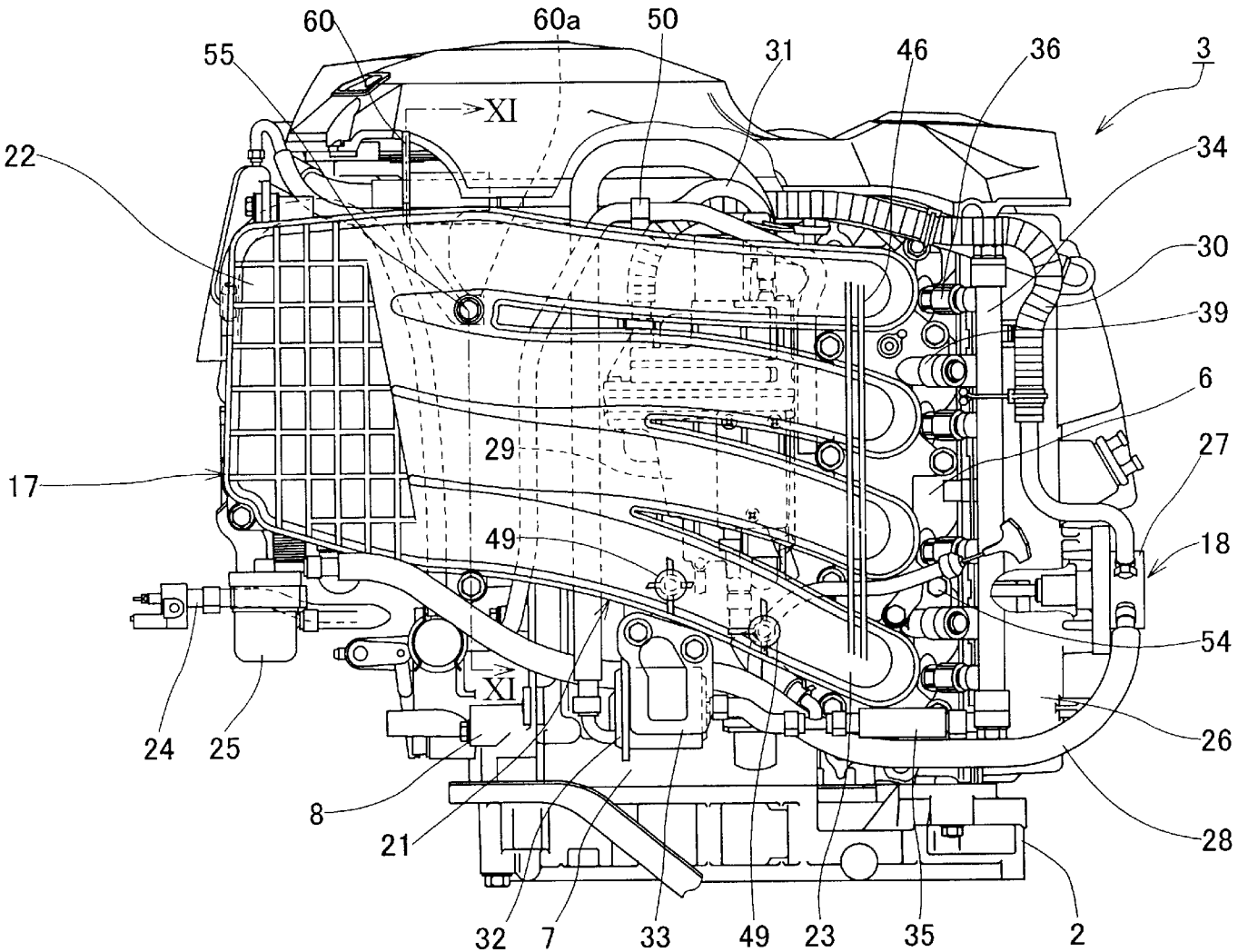
FIG. 2 is an enlarged side view of an engine of the outboard motor of FIG. 1.
Figure 3:
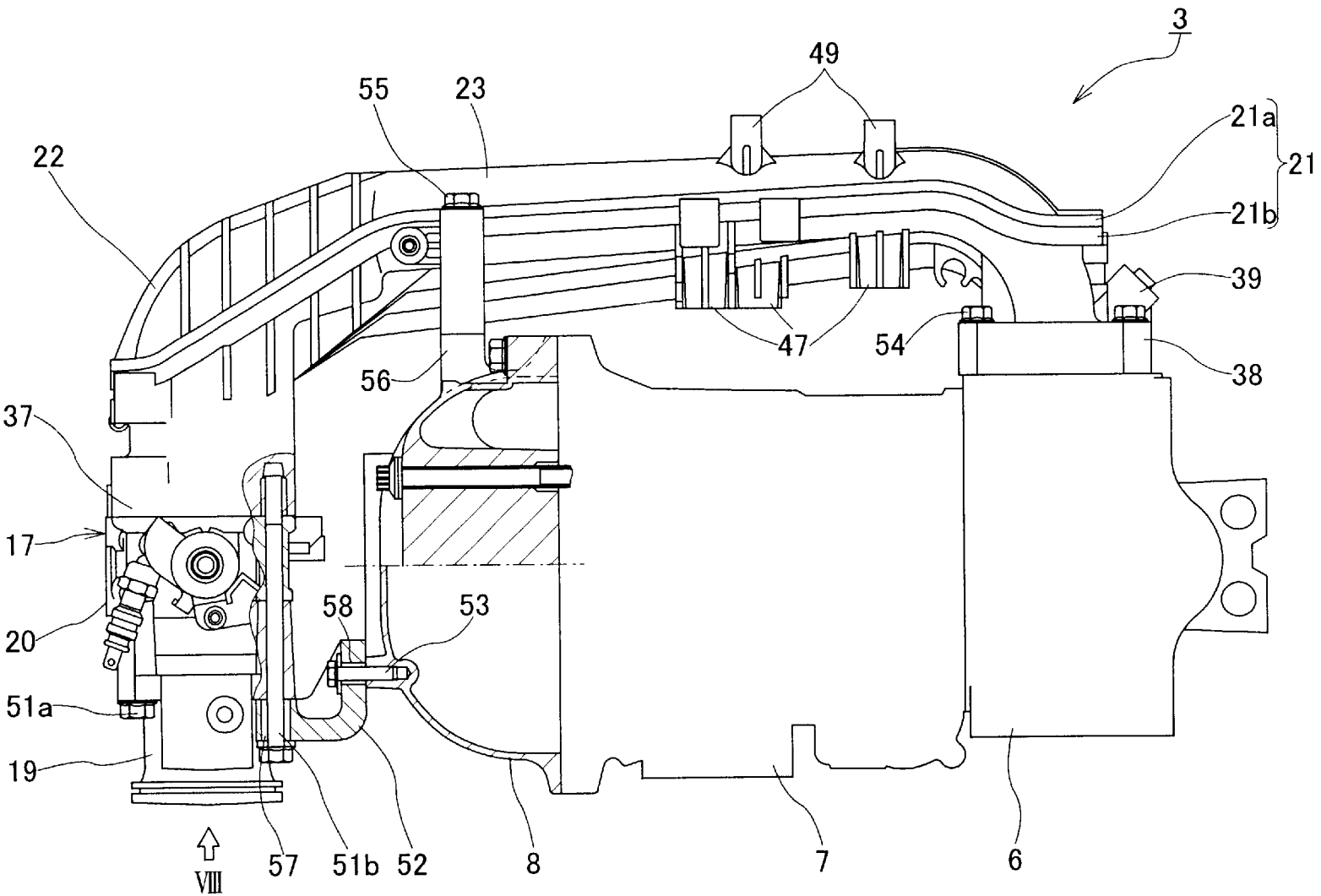
FIG. 3 is a bottom view of the engine.

FIG. 2 is an enlarged view of the engine 3. FIG. 3 is a bottom view of the engine 3. As shown in FIGS. 1, 2 and 3, the engine 3 mounted on the outboard motor 1 is, for example, a water-cooled four-stroke-cycle in-line four-cylinder engine. The engine 3 is constituted in combination of a cylinder head 6, a cylinder block 7, and a crankcase 8 and the like. Further, as shown in FIG. 1, the surrounding of the engine 3 is covered with an outboard motor cover 9.

The cylinder block 7 is arranged in the back (right side as viewed) of the crank case 8 arranged in the forefront of the engine 3 or in the left of FIGS. 1, 2 and 3. The cylinder head 6 is arranged in the back of the cylinder block 7. A crankshaft 10 is arranged almost perpendicularly in the coupling portion between the crankcase 8 and the cylinder block 7 (see FIG. 1).

As shown in FIG. 1, a drive shaft housing 11 is provided below the engine 3. A drive shaft 12 is constituted such that the upper end portion of the drive shaft 12 is fitted into the lower end portion of the crankshaft 10 through, for example, a spline connection, the drive shaft 12 extends downward in the drive shaft housing 11 and drives a propeller 16 through a bevel gear 14 and a propeller shaft 15 in a gear case 13 provided below the drive shaft housing 11.

An outfit such as electrical equipment, not shown, an intake system 17 and a fuel supply system 18 are arranged around the engine 3. The intake system 17 mainly comprises a silencer 19, a throttle body 20 and an intake manifold 21. The intake manifold 21 comprises a surge tank 22 and four branches 23 extending from the surge tank 22 to the respective cylinders of the engine.

The throttle body 20 which is one of the constitutional elements of the intake system 17 is arranged, for example, in front of the crankcase 8. The silencer 19 and the surge tank 22 of the intake manifold 21 are connected to the upstream and downstream sides of the throttle body 20, respectively. The branches 23 extending from the surge tank 22 almost horizontally are arranged on the side of the cylinder block 7 in vertical alignment and connected to respective intake ports, not shown, formed at the cylinder head 6.

The outboard motor 1 in this embodiment is provided with a fuel tank, not shown, on the hull side. A fuel supply hose 24 extending from the fuel tank is connected to a low-pressure fuel filter 25. A low pressure fuel pump 27 driven by a camshaft, not shown, which is the constitutional element of the valve system of the engine 3, is arranged on a cylinder head cover 26 covering the rear portion of the cylinder head 6. The low-pressure fuel pump 27 and the low-pressure fuel filter 25 are connected to each other through a low-pressure fuel hose 28.

A vapor separator 29 is provided in a space formed between the left side surface of the cylinder block 7 and the intake manifold 21. The vapor separator 29 separates fuel steam contained in liquid fuel such as gasoline and releases or returns only this steam in the air or to the intake system 17. The fuel is introduced from the low-pressure fuel pump 27 to the vapor separator 29 through the low-pressure fuel hose 30.

A high-pressure fuel pump, not shown, is provided in the vapor separator 29. The steam-separated fuel is forcedly fed from the high-pressure fuel pump to a high-pressure fuel filter 32 through a high-pressure fuel hose 31. This high-pressure fuel filter 32 is fixed to the lower portion of the intake manifold 21 through, for example, a bracket 33.

The high pressure fuel forcedly fed to the high pressure fuel filter 32 is fed to a delivery pipe 34 which is integrated with or integrally attached to the intake manifold 21 as will be described hereinlater, Through a high pressure fuel hose 35. The delivery pipe 34 is connected to fuel injectors 36 attached to the respective cylinders. These fuel injectors 36 inject high-pressure fuel into intake ports.

Figure 4:
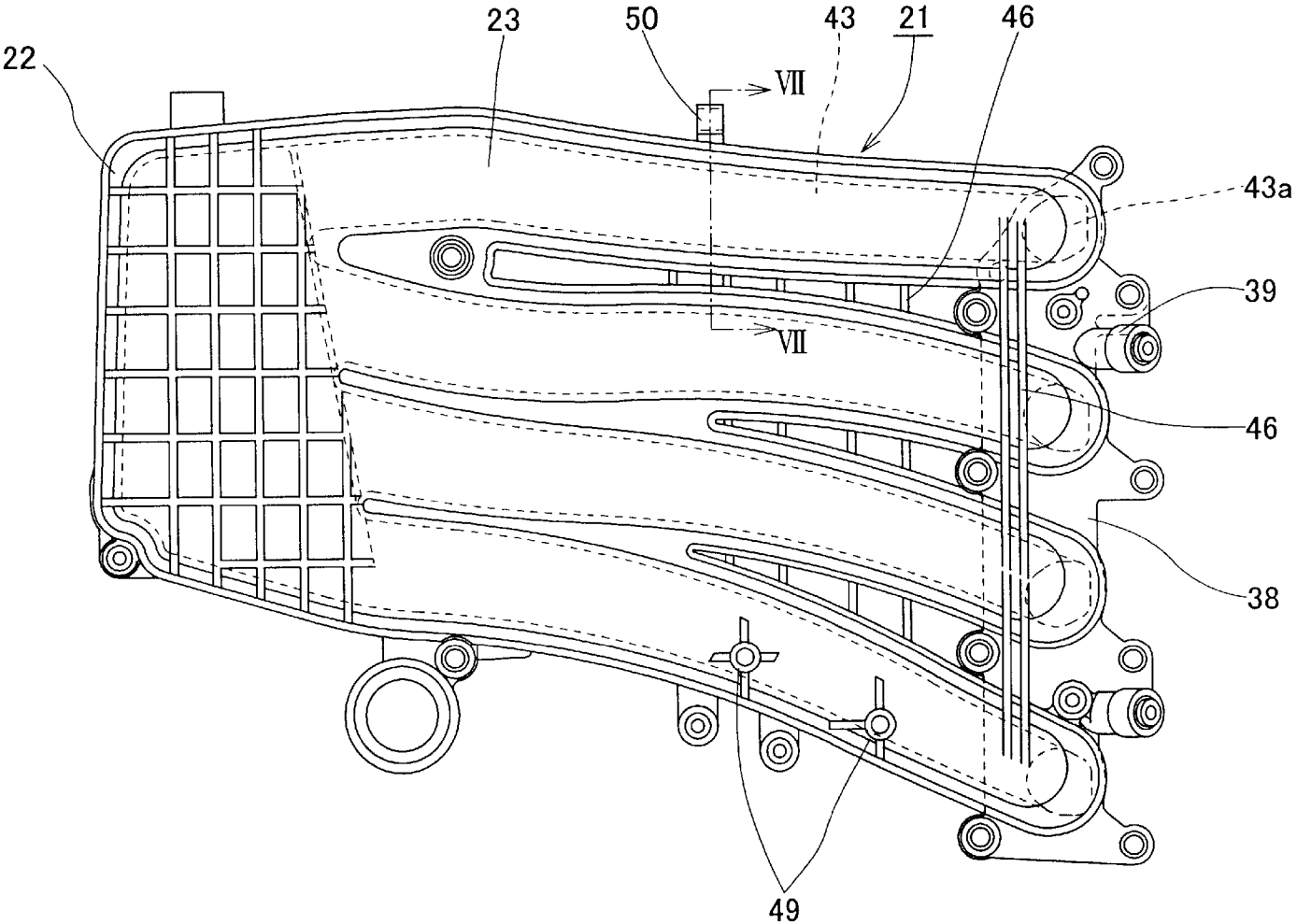
FIG. 4 is a left side view of only the intake manifold while being mounted to the engine.
Figure 5:
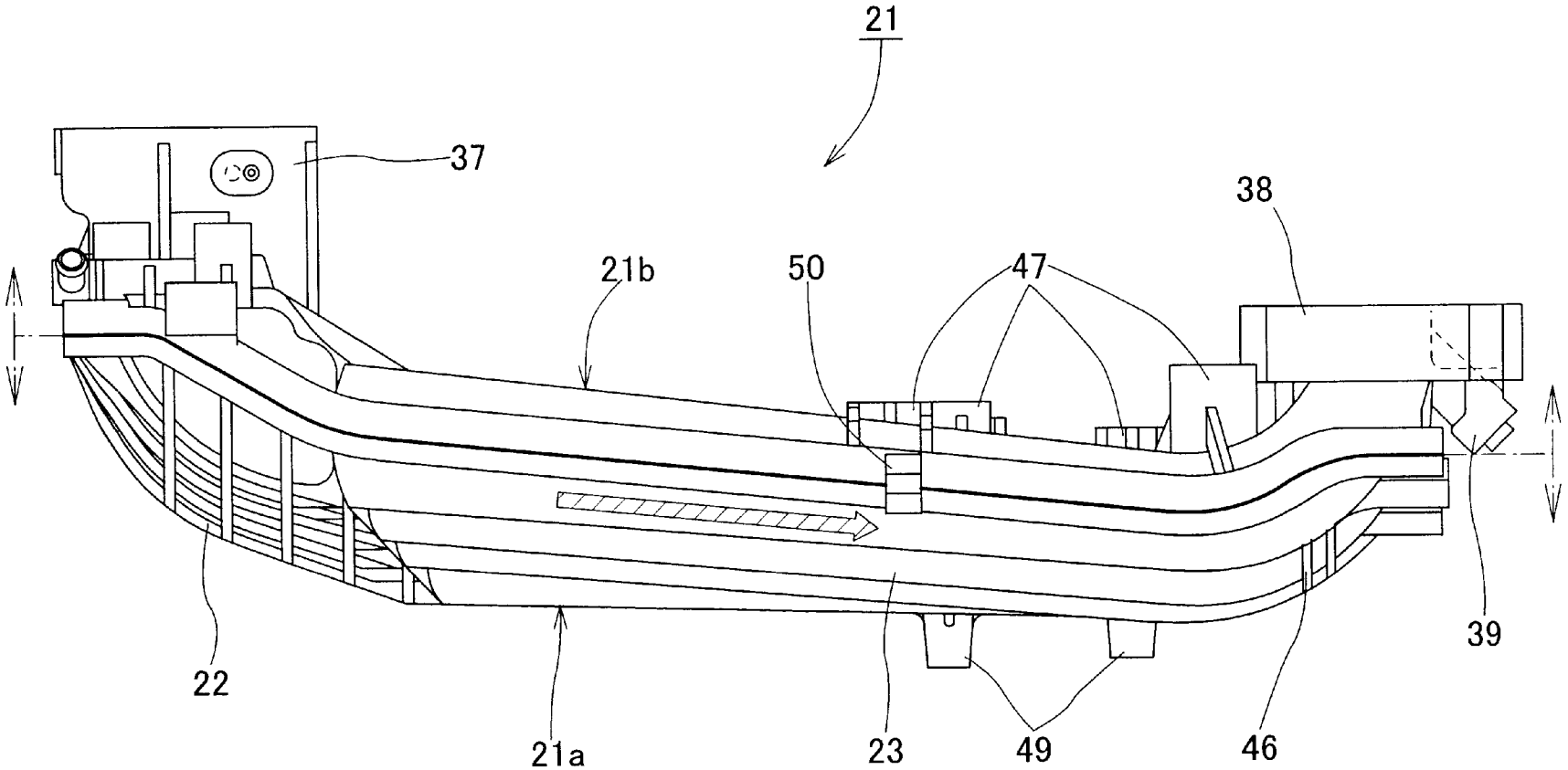
FIG. 5 is a top view of only the intake manifold.
Figure 6:
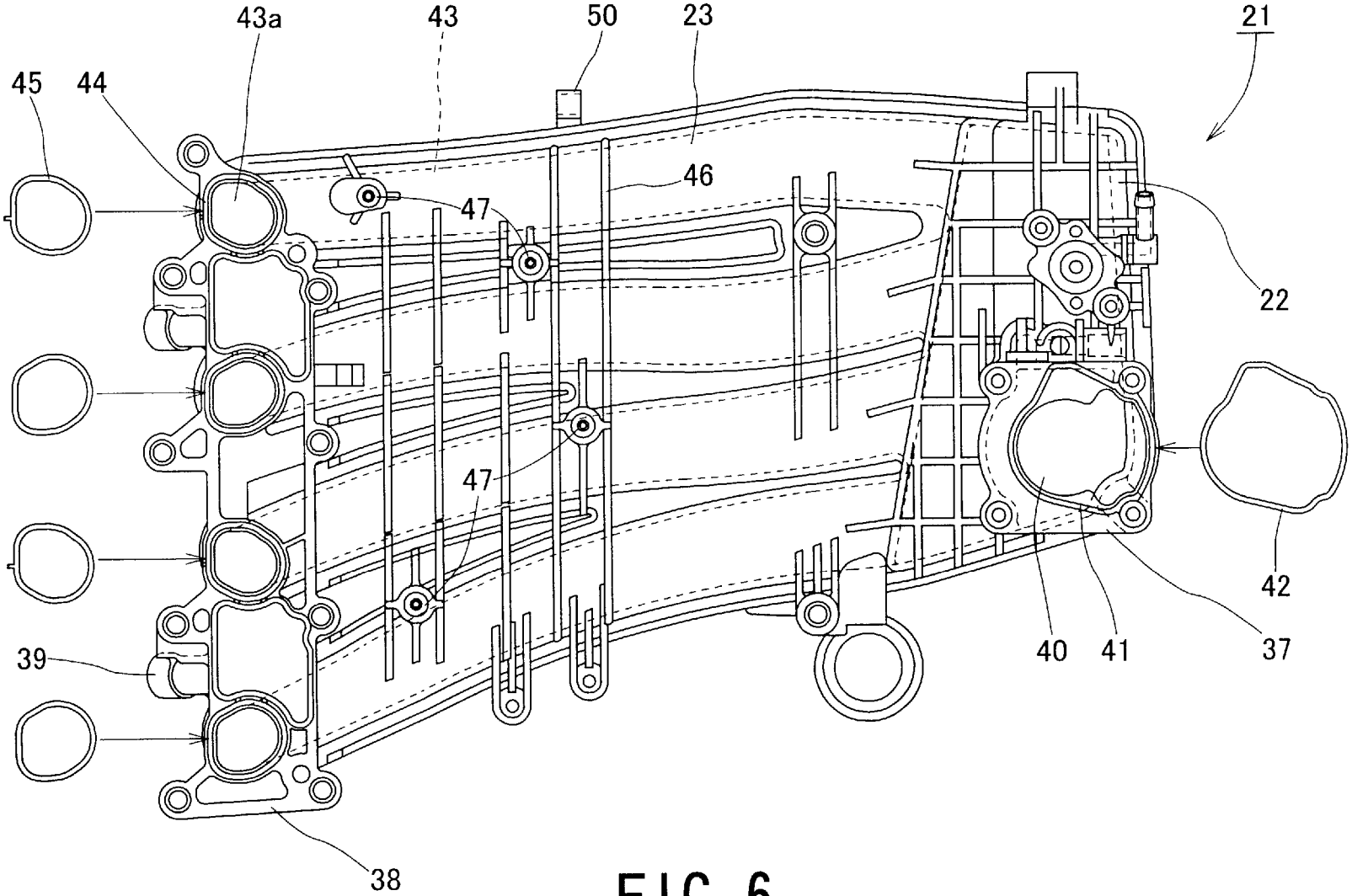
FIG. 6 is a right side view of only the intake manifold.
Figure 7:
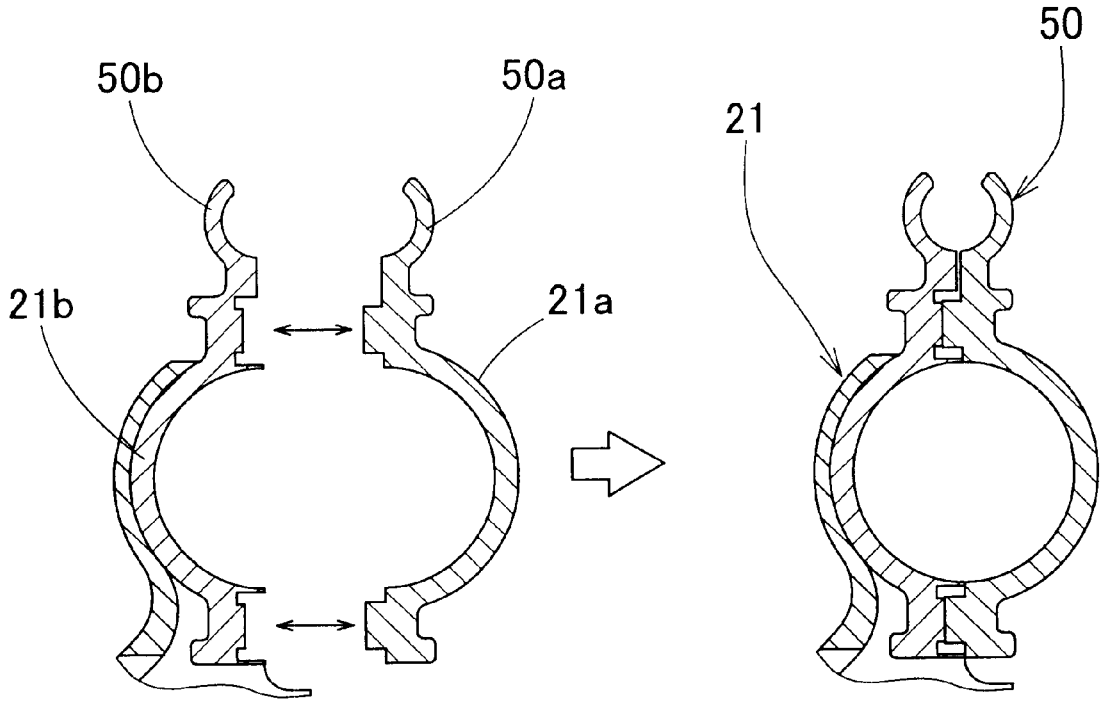
FIG. 7 is a sectional view taken along the line VII-VII of FIG. 4.
Figure 10:
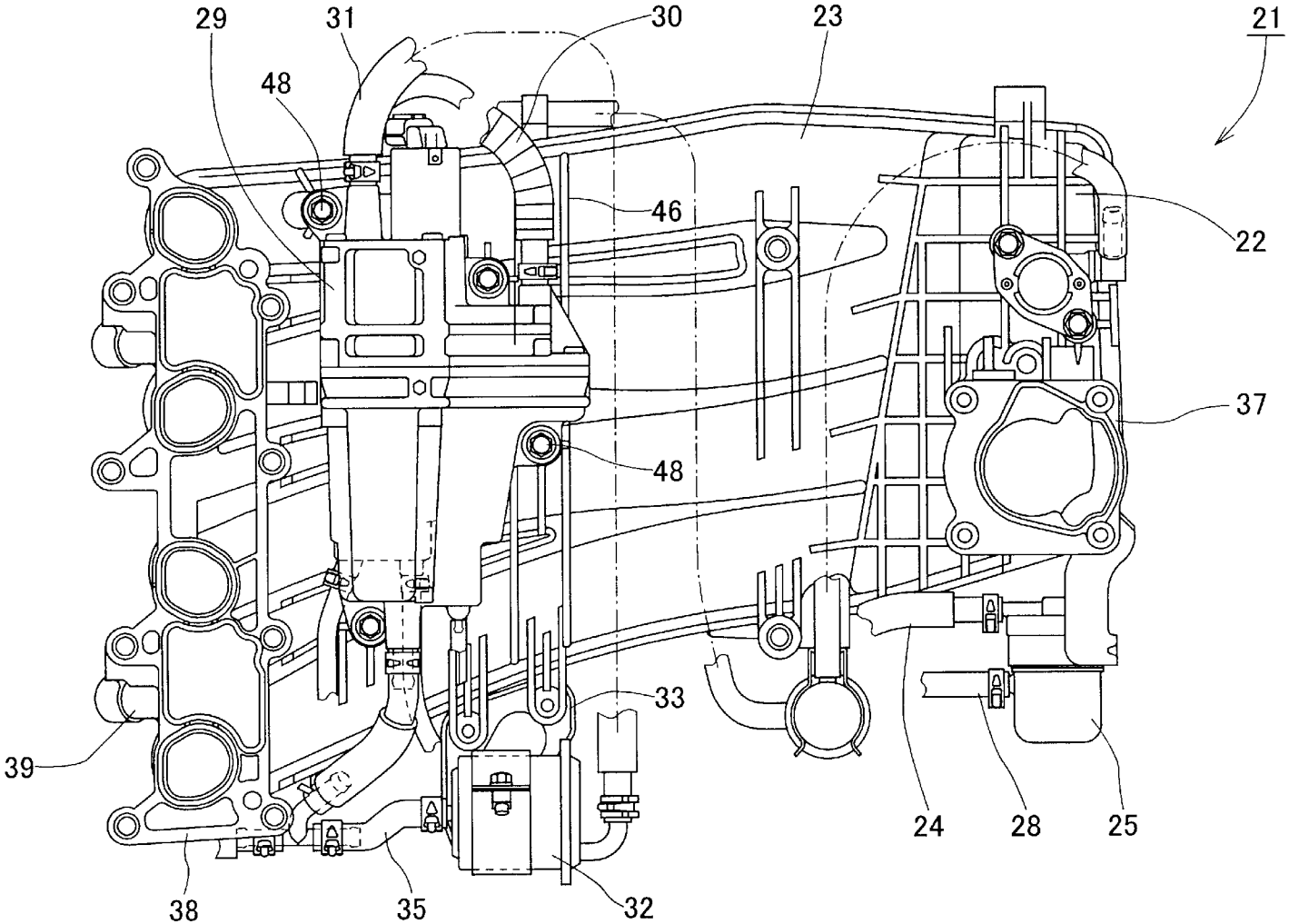
FIG. 10 is a right side view of only the intake manifold in a state that a portion of a fuel supply device is mounted thereto.

FIG. 4 is a right side view of only the intake manifold 21 in a state in which the manifold 21 is attached to the engine 3. FIG. 5 is a top view of only the intake manifold 21. FIG. 6 is a right side view of only the intake manifold 21. FIG. 7 is a right side view of only the intake manifold 21 in a state in which a part of the fuel supply system 18 is attached to the manifold 21. Furthermore, FIG. 10 is also a right side view of only the intake manifold to which a portion of a fuel supply device 18 is mounted. In FIGS. 4 to 7 and 10, the intake manifold 21 is formed of synthetic resin. Furthermore, as indicated by arrows, the intake manifold 21 is divided into two segments in a lateral direction (in a state in which the manifold 21 is attached to the engine 3), i.e., into an outside shell 21*a* and an inside shell 21*b* along the flow direction of intake air flowing in the branches 23.

The outside shell 21*a* and the inside shell 21*b* are formed by an injection method, respectively, and the mating surfaces of the shells 21*a* and 21*b* are coupled and integrated together by a vibrating welding method.

A mounting eye 37 for mounting the throttle body 20 is formed integrally with the surge tank 22 formed upstream of the intake manifold 21. A mounting eye 38 for mounting the engine 3 is formed integrally with the downstream ends of the branches 23 formed downstream of the intake manifold 21. The mounting eye 38 for the engine 3 extends longitudinally so as to couple the downstream ends of the respective branches 23 and a mounting boss 39 for mounting the delivery pipe 34 is formed integrally with the mounting eye 38. The delivery pipe 34 is directly fixed to the mounting boss 39.

As shown in FIG. 6, a groove 41 is formed on the outer periphery of an intake port 40 formed at the mounting eye 37 of the throttle body 20 and an O-ring 42 is inserted into the groove 41. Likewise, a groove 44 is formed on the outer periphery of the outlet 43*a* of an intake passage 43 formed at the mounting eye 38 of the branch 23 for the engine 3 and an O-ring 45 is fitted in the groove 44.

A plurality of reinforcement ribs 46 extending almost orthogonally to the axes of the branches 23, i.e., in the longitudinal direction, are formed integrally with the inside shell 21*b* on the engine side surface thereof so as to couple the branches 23 with one another. Furthermore, mounting bosses 47 for fixing the vapor separator 29 are provided, at at least four portions, on the engine side surface of the inside shell 21*b* and the vapor separator 29 is fixed to these mounting bosses 47 by, for example, bolts 48.

As shown in FIGS. 4 and 5, reinforcement ribs 46 extending in longitudinal direction are also formed on the surface of the outside shell 21*a* opposite to the engine 3. Furthermore, a plurality of support bosses for supporting the outboard motor in the horizontally falling state are formed integrally with the outside shell 21*a* at substantially the central portion of this surface.

FIG. 7 is a sectional view taken along the line VII-VII of FIG. 4. As shown in FIGS. 4 and 7, a hose clamp 50 holding a hose is provided on the upper surface of the intake manifold 21. This hose clamp 50 is halved laterally into halves 50*a* and 50*b*, which are formed integrally with the outside shell 21*a* and the inside shell 21*b*, respectively, so that the hose clamp 50 takes the form of a clamp when the both shells 21*a* and 21*b* are coupled together.

Figure 8:
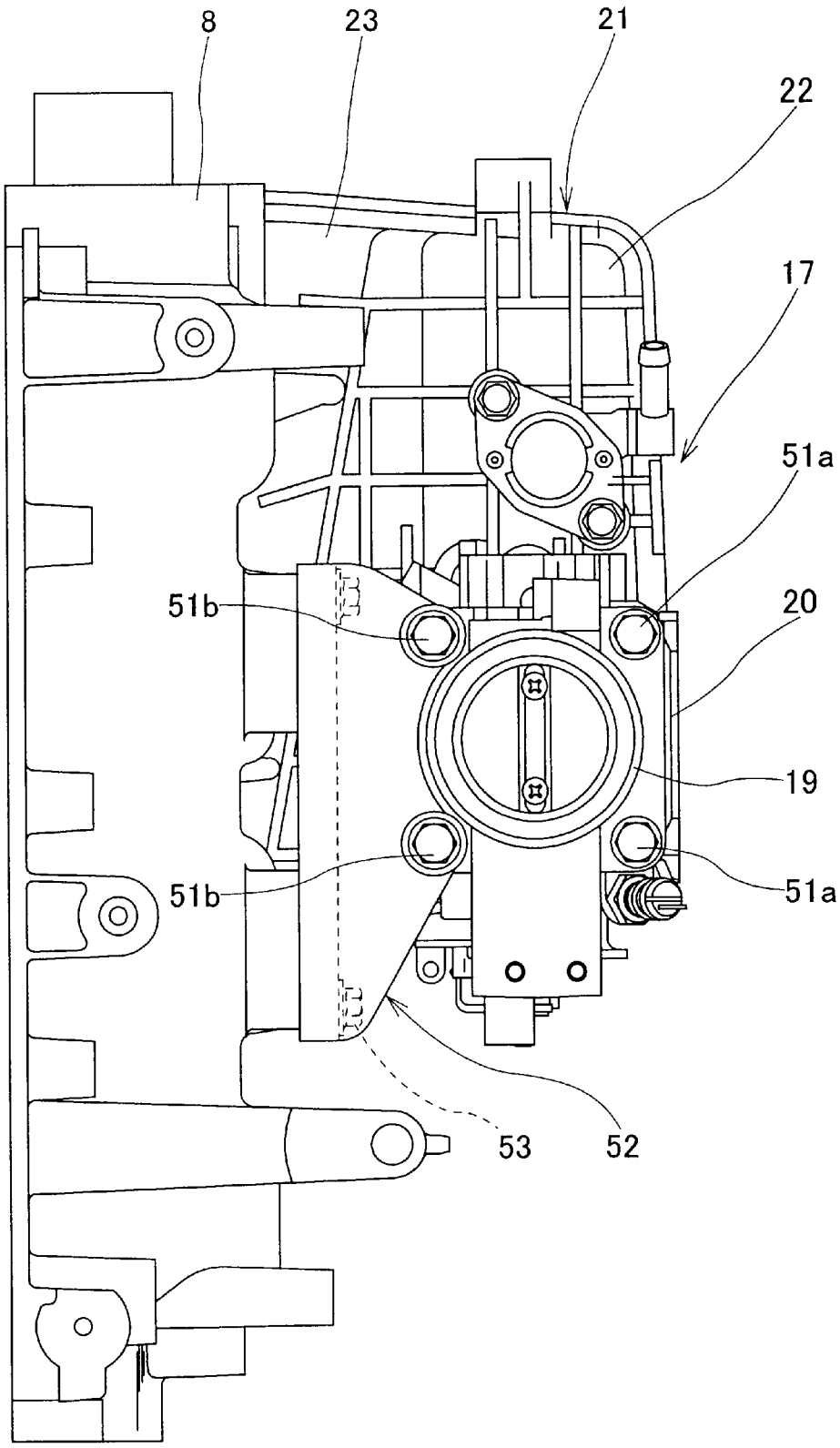
FIG. 8 is a view seen from VIII of FIG. 3.

FIG. 8 is a view seen from VIII of FIG. 3. As shown in FIGS. 3 and 8, the silencer 19, the throttle body 20 and the surge tank 22 of the intake manifold 21 are integrated with one another by a plurality of bolts 51*a* and 51*b*. The intake system 17 thus integrated with one another is attached to, for example, the crankcase 8 of the engine 3 by other bolts 53 through a bracket 52. At this time, the bracket 52 is fastened to the intake system 17 by the bolt 51*b*.

Further, as shown in FIGS. 2 and 3, the mounting eye 38 formed on the downstream ends of the branches 23 for the engine 3 is directly fixed to the cylinder head 6 by, for example, bolts 54. In addition, upper and lower portions, for example, on the upstream sides of the branches 23 are directly fixed to a boss 56 provided at the crankcase 8 by, for example, a bolt 55.

Figure 9A:
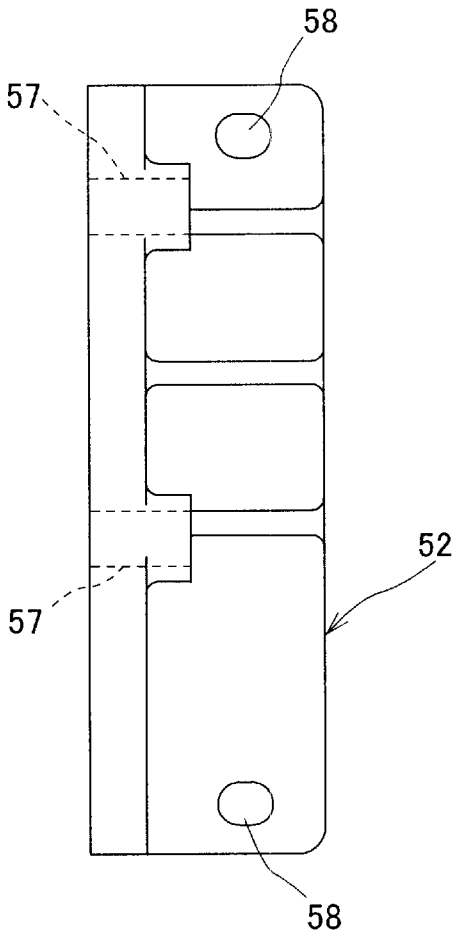
FIGS. 9A, 9B and 9C show three surfaces of an intake device attachment bracket, respectively.
Figure 9B:
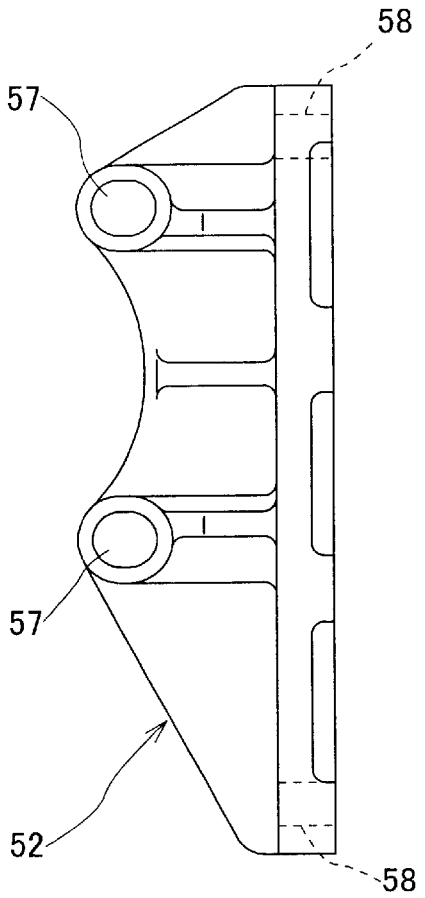
Figure 9C:
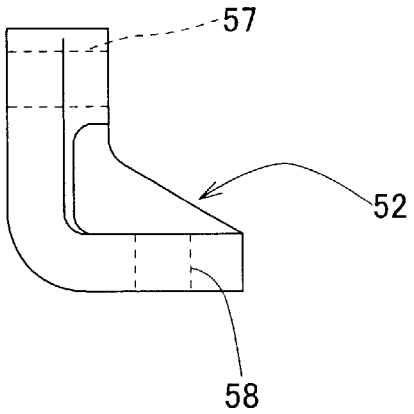

FIGS. 9A, 9B and 9C show the three surfaces of the intake system attachment bracket 5, respectively. As shown in FIGS. 9A, 9B and 9C, bolt holes 57 for the intake system integrating bolts 51*b* and bolt holes 58 for the bolts 53 for attaching the intake system 17 to the crankcase 8 are provided in the bracket 52. These bolt holes 57 and 58 are formed into the shapes of long holes, i.e. slots.

Figure 11:
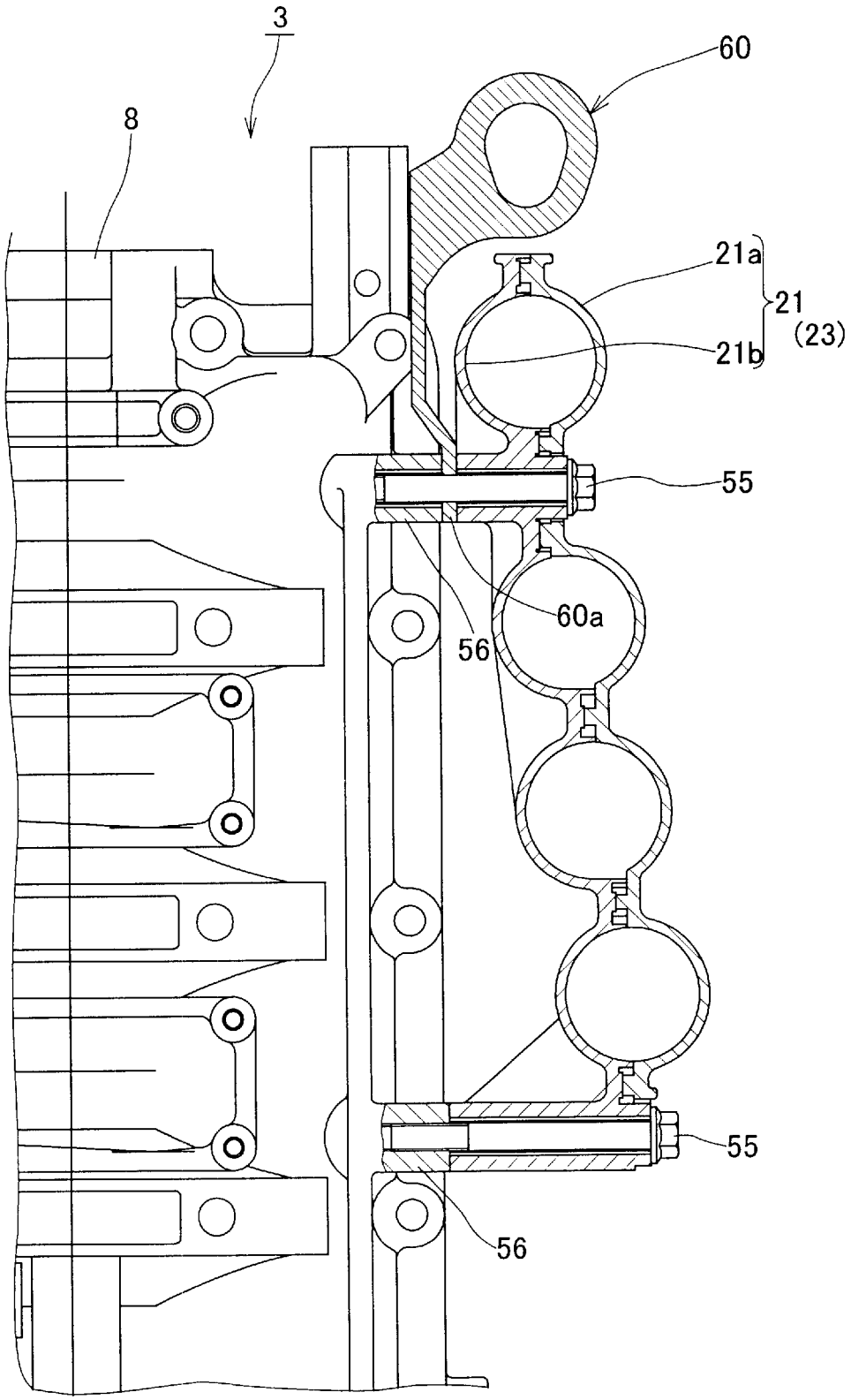
FIG. 11 is a sectional view taken along the line XI-XI in FIG. 2.

FIG. 11 is a sectional view taken along the line XI-XI in FIG. 2. With reference to FIGS. 2 and 11, the outboard motor 1 is provided with a hook 60 by which the engine 3 of the outboard motor 1 is suspended by usinhg a crane, for example. The engine hook 60 is mounted in a clamped state between the engine 3 and the intake manifold 21. More specifically, the engine hook 60 has a mounting portion 60*a* which is disposed between the inside of the branch 23 and the boss 56 to which the upper side of the upstream side branch 23 and the mounting portion 60*a* is fastened by means of bolt 55 for fixing the branch 23.

Next, the function of this embodiment will be described.

Since the intake manifold 21 is formed of synthetic resin, the intake manifold 21 is lighter in weight than that formed of aluminum alloy. In addition, since a sand core is employed to form intake passages in the branches of the intake manifold made of aluminum alloy, the surfaces of the passages are rough and intake air is applied with resistance. In case of the intake manifold 21 made of resin, in comparison, the surfaces of intake passages 43 in the branches 23 thereof can be formed far smoother, and intake air resistance can be reduced accordingly.

Moreover, since heat is less propagated through the resin made intake manifold from the engine in comparison with the aluminum alloy one, it is possible to decrease intake air temperature. As a result, air filling efficiency is increased and power output level can be improved. Besides, synthetic resin is less expensive in unit price than aluminum alloy and cost reduction can be, therefore, realized. Accordingly, even if the delivery pipe 34 is directly fixed to the intake manifold 21, the heat of the engine is hardly transmitted to the delivery pipe 34. As a result, any insulator conventionally used for the intake manifold made of aluminum alloy becomes unnecessary, thus reducing parts or members for assembly and improving the assembling workability and assembling reliability.

Furthermore, the intake manifold 21 is laterally halved into the outside shell 21*a* and the inside shell 21*b* along the flow direction of the intake air flowing in the branches 23 thereof (in a state that the intake manifold 21 is attached to the engine 3) and formed through an injection method. According to such arrangement, compared with a melt core method frequently used to form an internal hollow structure made of resin, it is possible to reduce plant and investment cost and to thereby reduce the total cost. Further, since both the shells 21*a* and 21*b* are coupled together by a vibration welding method, higher coupling strength can be obtained than that for coupling the shells with an adhesive agent.

The intake manifold 21 used for the outboard motor 1 is linearly shaped compared with an intake manifold used for an automobile. It is, therefore, possible to divide the intake manifold 21 suitably for the vibration welding method.

On the other hand, the mounting eye 38 formed on the downstream ends of the branches 23 to mount the intake manifold to the engine 3 is directly fixed to the cylinder head 6 by means of bolts 54. The upper and lower portions of the branches 23 on the upstream sides are directly fixed to the boss 56 provided at the crankcase 8 by the bolts 55. The throttle body 20 attached to the surge tank 22 of the intake manifold 21 is attached to the crankcase 8 of the engine 3 through the bracket 52 by the bolts 53. It is, therefore, possible to increase mounting rigidity. As a result, the intake manifold 21 is not resonated by the vibration of the engine 3 and the durability of the intake manifold 21 can be thereby improved.

Furthermore, while the resin intake manifold 21 is slightly deformed according to a temperature change and a water absorption state, the deformation can be absorbed by forming the bolt holes 57 for the intake system integrating bolts 51b provided at the bracket 52. The bolt holes 58 for the bolts 53 for attaching the intake manifold 21 to the crankcase 8 are formed into the shapes of long holes. It is, therefore, possible to assemble the intake manifold 21 with the engine 3.

The rigidity of the intake manifold 21 can be increased by providing a plurality of reinforcement ribs 46 extending in the longitudinal direction almost orthogonally to the axes of the branches 23 of the intake manifold 21 to the front and rear surfaces of the branches 23, respectively, so as to couple the respective branches 23 one another. Furthermore, even if seawater enters the interior of the outboard motor 9, seawater does not remain around the reinforcement ribs 46, thereby making it possible to prevent salt from adhering to the intake manifold 21.

The hose clamp 50 provided on the upper surface of the intake manifold 21 is laterally halved into halves 50*a* and 50*b*, which are integrally formed with the outside shells 21*a* and the inside shells 21*b*, respectively, so that the halves 50*a* and 50*b* take the form of a clamp when both the shells 21*a* and 21*b* are coupled together. According to this structure, the number of parts and the number of assembling steps are reduced and the attachment of a clamp to the intake manifold 21 becomes unnecessary. Moreover, the hose clamp 50 can be formed so as not to abut burrs formed by a parting line generated at the formation of the hose clamp 50 against the hose, and the damage of the hose can be, therefore, prevented.

Meanwhile, since it is difficult to flatten the surfaces of the resin intake manifold 21 on which with the intake manifold 21 are coupled to the cylinder head 6 and the throttle body 20, it is difficult to seal the coupling surfaces by using metal gasket or paper gasket unlike the aluminum alloy intake manifold.

However, the groove 41 is formed on the outer periphery of the intake port 40 formed at the mounting eye 37 for the throttle body 20, and the O-ring 42 is fitted into the groove 41. Likewise, the groove 44 is formed on the outer periphery of the outlet 43*a* of the intake passage 43 formed at the mounting eye 38 of the branches 23 for the engine 3 and the O-ring 45 is fitted into the groove 44. Accordingly, it is possible to seal the coupling surfaces on which the intake manifold 21 is coupled to the cylinder head 6 and the throttle body 20. In addition, by forming the grooves 41 and 44 to the intake manifold 21 side and fitting the O-rings 42 and 45 into the grooves 41 and 44, respectively, the assembling performance can be more improved than that in case of using the metal gasket or paper gasket.

Furthermore, according to the present invention, the mounting bosses 47 for fastening the vapor separator 29 to the engine side surface of the inside shell 21*b* of the intake manifold 21 at at least four portions thereof, and the vapor separator 29 is fixed to these mounting bosses 47 by means of bolts 48. Accordingly, the oscillation of the vapor separator due to the vibration of the engine 3 can be significantly suppressed. Moreover, the plural location of the mounting bosses 47 can disperse the load to be applied to the respective bosses 47, thus improving the durability of the intake manifold made of resin.

Still furthermore, the mounting portion 60*a* of the engine hook 60 is disposed between the inside of the branch 23 and the boss 56 to which the upper side of the upstream side branch 23 is fixed, and the mounting portion 60*a* is fastened by means of bolt 55 for fixing the branch 23. According to this structure, when the engine is suspended, the load is applied to the engine side boss 56 and the branch fixing bolt 55 and is not applied to the intake manifold, thus being advantageous.

Still furthermore, a plurality of support bosses 49 for supporting the outboard motor 1 at a time of being disposed horizontally are provided at substantially the central portion of the branch 23 to be integrally with the outside shell 21*a* in a projecting manner. According to this arrangement, the bosses 49 are positioned at the most high strong position in structure to thereby effectively support the outboard motor 1.

Furthermore, it is to be noted that the present invention is not limited to the described embodiments and many other changes, modifications and alternations may be made without departing from the scopes of the appended claims.

That is, for example, in the above-stated embodiment, description has been given while taking a case of applying the present invention to an in-line four-cylinder engine as one preferred example. As long as the engine is a multiple-cylinder engine, the in-line four-cylinder engine may be replaced with an engine of three or less cylinders or five or more cylinders or replaced with a V-type engine. In addition, in the above-stated embodiment, description has been given while taking a case of halving the intake manifold 21 as an example. Alternatively, by dividing the intake manifold 21 into three or four segments, the present invention may be applicable to an intake manifold having a more complex shape or more complex structure In the above-stated embodiment, description has been given while taking a case of fixing the intake manifold 21 to the cylinder head 6 and the crankcase 8 as an example. Alternatively, the intake manifold 21 may be fixed to the cylinder block 7. In the embodiment, description has been given while taking a case of fixing the intake manifold 21 to the crankcase 8 through the bracket 51 attached to the throttle body 20 as an example. Alternatively, the bracket may be directly attached to the intake manifold 21. Further, instead of employing the bracket 52, a boss, not shown, for example, may be provided on the engine 3 side and the intake manifold 21 and the throttle body 20 may be mounted to this boss.

What is claimed is:

1. An intake manifold of an outboard motor which is mounted with a multiple-cylinder engine and in which intake air is distributed by the intake manifold to respective cylinders of the engine, said intake manifold being formed of synthetic resin and comprising:

a surge tank; and a branch including a plurality of branch sections extending from the surge tank to the respective cylinders, wherein said surge tank and said branch constitute an intake manifold body which is divided along a flow direction of the intake air flowing in the branch sections, and wherein the intake manifold body is fixed to the engine directly at one portion and is fixed thereto, at another portion, through a throttle body to which a bracket is connected, said bracket being formed with bolt holes in shape of slots.

2. An intake manifold of an outboard motor according to claim 1, wherein said intake manifold body has mating surfaces between the intake manifold body and the engine and between the intake manifold body and the throttle body, and sealing means are formed to the mating surfaces.

3. An intake manifold of an outboard motor according to claim 2, wherein each of said sealing means is composed of a groove formed to the mating surface and an O-ring fitted to said groove.

4. An intake manifold of an outboard motor according to claim 1, wherein said divided intake manifold body is joined together by a vibration welding method.

5. An intake manifold of an outboard motor which is mounted with a multiple-cylinder engine and in which intake air is distributed by the intake manifold to respective cylinders of the engine, said intake manifold being formed of synthetic resin and comprising:

a surge tank; and a branch including a plurality of branch sections extending from the surge tank to the respective cylinders, said surge tank and said branch constituting an intake manifold body which is divided along a flow direction of the intake air flowing in the branch sections, and wherein said intake manifold body is provided with a plurality of reinforcement ribs extending in longitudinal direction thereof.

6. An intake manifold of an outboard motor which is mounted with a multiple-cylinder engine and in which intake air is distributed by the intake manifold to respective cylinders of the engine, said intake manifold being formed of synthetic resin and comprising:

a surge tank; and a branch including a plurality of branch sections extending from the surge tank to the respective cylinders, said surge tank and said branch constituting an intake manifold body which is divided along a flow direction of the intake air flowing in the branch sections, and wherein said intake manifold body is provided with a hose clamp, said hose clamp is divided into halves, which are formed integrally with the divided portion of the intake manifold body, respectively, so that said divided halves take a form of a clamp when the divided portions of the intake manifold body are coupled together.

7. An intake manifold of an outboard motor which is mounted with a multiple-cylinder engine and in which intake air is distributed by the intake manifold to respective cylinders of the engine, said intake manifold being formed of synthetic resin and comprising:

a surge tank; and a branch including a plurality of branch sections extending from the surge tank to the respective cylinders, said surge tank and said branch constituting an intake manifold body which is divided along a flow direction of the intake air flowing in the branch sections, and wherein at least four attachment bosses for fixing an outfit of an outboard motor is provided on a surface of the intake manifold body on the side of the engine and the outfit is fixed to the attachment bosses.

8. An intake manifold of an outboard motor according to claim 7, wherein a mounting section of an engine hook for suspending the engine is arranged between an intake manifold fixing bosses provided at the engine and an interior of the intake manifold body so as to be fastened together by a bolt for fixing the intake manifold body.

9. An intake manifold of an outboard motor according to claim 7, wherein a support boss used at a time of disposing an outboard motor to be sideways is disposed at substantially a central portion of the branch in a protruded manner.

10. An intake manifold for an outboard motor according to claim 7, wherein a delivery pipe constituting a fuel supply device is directly attached to the intake manifold body.

* * * * *